US007523825B2

(12) United States Patent
Velazquez et al.

(10) Patent No.: US 7,523,825 B2
(45) Date of Patent: Apr. 28, 2009

(54) PACKAGING COMPONENT FOR PERSONAL CARE ARTICLES

(75) Inventors: Herb Flores Velazquez, Neenah, WI (US); Juliette Alison Hill, London (GB); Michael J. Thomsen, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 826 days.

(21) Appl. No.: 10/955,429

(22) Filed: Sep. 30, 2004

(65) Prior Publication Data

US 2006/0071061 A1 Apr. 6, 2006

(51) Int. Cl.
*A61B 17/06* (2006.01)

(52) U.S. Cl. ..... 206/440; 206/812; 206/823

(58) Field of Classification Search ..... 206/438, 206/440, 812, 204, 581, 38, 37, 823
See application file for complete search history.

(56) References Cited

U.S. PATENT DOCUMENTS 1,628,121 A 5/1927 Covel (Continued)

FOREIGN PATENT DOCUMENTS

| | | | |
|---|---|---|---|
| CA | 2 025 856 | A1 | 3/1991 |
| EP | 1 174 104 | A1 | 1/2002 |
| GB | 2 269 162 | A | 2/1994 |
| WO | WO 98/06369 | A1 | 2/1998 |

(Continued)

OTHER PUBLICATIONS

US 5,699,911, 12/1997, Joseph et al. (withdrawn)

*Primary Examiner*—Jacob K Ackun, Jr.
(74) *Attorney, Agent, or Firm*—Ralph H. Dean, Jr.; Sebastian C. Pugliese, I; H. Michael Kubicki

(57) ABSTRACT

The present invention provides a discrete package for absorbent personal care articles. Provided by the present invention is a personal care product having a container component and an absorbent personal care product component. The container component has a top panel, a bottom panel, at least one side. Generally there are four side walls, a front side wall, a back side wall, a first side wall and a second side wall. These walls are connected in a manner such that the top panel is connected to the bottom panel by the front side wall, the back side wall, the first side wall and the second side wall; and the front side wall is connected to the back side wall by the first side wall and the second side wall. Each wall of the container has an inside surface and an exterior surface. The inside surface of each of the bottom panel, the front side wall, the back side wall, the first side wall and the second side wall define a chamber for holding at least one absorbent personal care article. The chamber is able to hold at least one absorbent personal care article component placed within said chamber of the container component. In addition, the container component is devoid of any indicia on exterior surface of each of the top panel, the front side wall, the first side wall and the second side wall which tends to indicate that the container has at least one personal care product placed within said chamber. With these walls being devoid of any indicia indicating the contents of the container, the container of the present invention, with its contents of absorbent personal care articles can be left in the open without clearly indicating the contents of the container.

3 Claims, 6 Drawing Sheets

U.S. PATENT DOCUMENTS

| | | | | |
|---|---|---|---|---|
| 2,359,679 | A | 10/1944 | Roehrl | |
| 2,361,659 | A | 10/1944 | Smith | |
| 2,672,273 | A | 3/1954 | Smith | |
| 2,944,726 | A | 7/1960 | Mccauley | |
| 3,062,430 | A | 11/1962 | Rutledge | |
| 3,099,381 | A | 7/1963 | Meyers | |
| 3,100,074 | A | 8/1963 | Beck | |
| 3,207,416 | A | 9/1965 | Koltz et al. | |
| 3,486,682 | A | 12/1969 | Mahon et al. | |
| D218,677 | S | 9/1970 | Biallo | |
| D219,266 | S | 11/1970 | Biallo | |
| 3,608,812 | A | 9/1971 | Hamilton | |
| 3,642,194 | A | 2/1972 | Scully | |
| 3,653,582 | A | 4/1972 | Scully | |
| 3,680,767 | A | 8/1972 | De Lorenzo et al. | |
| 3,858,788 | A | 1/1975 | Phillips, Jr. | |
| 3,899,125 | A | 8/1975 | Andrews et al. | |
| 3,910,487 | A | 10/1975 | Jaeschke | |
| 3,918,631 | A | 11/1975 | Hackenberg | |
| 3,942,712 | A | 3/1976 | Bundy et al. | |
| 3,963,173 | A | 6/1976 | Stone | |
| 4,048,052 | A | 9/1977 | Tolaas | |
| 4,049,190 | A | 9/1977 | O'Neill | |
| 4,113,104 | A | 9/1978 | Meyers | |
| 4,127,229 | A | 11/1978 | Roccaforte | |
| 4,150,748 | A | 4/1979 | Mueller | |
| 4,284,197 | A | 8/1981 | Meyers | |
| 4,289,240 | A | 9/1981 | Mueller | |
| 4,314,643 | A | 2/1982 | Forbes, Jr. | |
| 4,436,206 | A | 3/1984 | Kuchenbecker | |
| 4,526,317 | A | 7/1985 | Cassidy | |
| 4,569,475 | A | 2/1986 | Cassidy | |
| 4,773,542 | A | 9/1988 | Schillinger et al. | |
| 4,948,038 | A | 8/1990 | Moeller | |
| 4,955,469 | A | 9/1990 | Hudspith | |
| 4,964,526 | A | 10/1990 | Stephens | |
| 5,044,547 | A | 9/1991 | Hartman | |
| 5,044,550 | A | 9/1991 | Lamm | |
| 5,183,202 | A | 2/1993 | Love | |
| 5,265,799 | A | 11/1993 | Stone | |
| 5,314,114 | A | 5/1994 | Stone | |
| 5,322,215 | A | 6/1994 | Roccaforte | |
| 5,511,722 | A | 4/1996 | Dixon | |
| 5,634,588 | A | 6/1997 | Jørgensen-Beck et al. | |
| 5,653,384 | A | 8/1997 | Shaikh | |
| 5,730,294 | A | 3/1998 | Blosser et al. | |
| 5,749,462 | A | 5/1998 | Houghton | |
| 5,911,359 | A | 6/1999 | Stone et al. | |
| 6,015,045 | A | 1/2000 | Joseph et al. | |
| D433,942 | S | 11/2000 | Persson et al. | |
| 6,164,444 | A | 12/2000 | Bray et al. | |
| 6,173,837 | B1 | 1/2001 | Marconi | |
| D447,689 | S | 9/2001 | Navet et al. | |
| D460,355 | S | 7/2002 | Lenz et al. | |
| D461,122 | S | 8/2002 | Bryan et al. | |
| 6,478,149 | B1 | 11/2002 | Parker | |
| 6,481,576 | B1 | 11/2002 | Watkins | |
| 6,601,706 | B2 | 8/2003 | Mcmanus et al. | |
| 6,688,466 | B2 | 2/2004 | White et al. | |
| 6,695,144 | B2 | 2/2004 | Freeze | |
| 6,708,823 | B2 | 3/2004 | Cottingham et al. | |
| 2002/0079246 | A1 | 6/2002 | Ling et al. | |
| 2002/0170841 | A1 | 11/2002 | Persson | |
| 2003/0102238 | A1* | 6/2003 | White et al. | 206/438 |
| 2003/0116614 | A1 | 6/2003 | Block et al. | |
| 2003/0130632 | A1 | 7/2003 | Costea et al. | |
| 2004/0050738 | A1* | 3/2004 | Molina et al. | 206/440 |
| 2004/0060974 | A1 | 4/2004 | Dacey | |
| 2004/0176734 | A1 | 9/2004 | Rasmussen et al. | |
| 2004/0186448 | A1 | 9/2004 | Misek et al. | |
| 2005/0121347 | A1* | 6/2005 | Hanson | 206/440 |
| 2005/0133395 | A1* | 6/2005 | Mishima et al. | 206/438 |
| 2005/0145523 | A1* | 7/2005 | Zander et al. | 206/438 |

FOREIGN PATENT DOCUMENTS

| | | | |
|---|---|---|---|
| WO | WO 02/17844 | A2 | 3/2002 |
| WO | WO 02/36443 | A1 | 5/2002 |
| WO | WO 03/031272 | A1 | 4/2003 |

* cited by examiner

PACKAGING COMPONENT FOR PERSONAL CARE ARTICLES

FIELD OF THE INVENTION

The present invention relates generally to a personal care product, and in particular, to a container component for personal care products.

BACKGROUND OF THE INVENTION

Absorbent personal care articles are generally known in the art as products of a personal hygiene or health care nature. Such products include, for example, incontinence articles, diapers, feminine hygiene products, and the like. These absorbent personal care articles have been generally provided to users in packages such as paper containers, generally in the form of a box or carton, or soft side packages such as polymer film bags. These products are typically packaged so that there is no question to the users and non-users as to what the package contains. The current packages for these personal care articles always have indicia on most, if not all, sides of the packages which clearly indicate the contents of the package.

As a result of these indicia, the containers with the absorbent personal care products are often stored in closed storage areas, such as cabinets and drawers, to effectively hide the personal care products from the sight of others. However, when these items are placed in closed storage, it is often easy for users to forget to use the products, on a daily basis or when the product is needed, especially when the user is pressed for time. Often the absorbent personal care products are stored near the place of use, which is usually a place where privacy is available, such as a bathroom or bedroom. Further, in many older homes, and relatively cramped living quarters, such as college dorms, small apartments and the like, closed storage in bathrooms or bedrooms is many times not available or is available on a limited basis. As a result, many times the absorbent personal care products must be stored in the open and in plain view for others, other than the user, to see. This can lead to embarrassment or unnecessary distress for the user of these products, especially when the user must share a space with a nonuser, including guests, such as a bathroom.

In the case of feminine care products, such as sanitary napkins, pantiliners and the like, there is a need for absorbent articles that can provide a possible emotional benefit to the user. Many females experience a down turn in their mood during the menstrual period. Generally, feminine care products and the packaging associated with these products provide little, if any, emotional benefit to the user. Therefore, there is a need in the art to provide a possible emotional benefit to the users of the feminine care products.

SUMMARY OF THE INVENTION

Generally stated, the present invention provides a solution to the problem of discreteness of the packaging component for absorbent personal care articles. Provided by the present invention is a package of personal care products having a container component and a plurality of absorbent personal care articles. The container component is devoid of any indicia on the exterior surface of at least one side wall and a top panel present on the container. With these walls being devoid of any indicia indicating the contents of the container, the container of the present invention, with its contents of absorbent personal care articles can be left in plain sight without clearly conveying that the container has personal care products placed.

In another aspect of the present invention, the container component has a top panel, a bottom panel, a front side wall, a back side wall, a first side wall and a second side wall. These walls are connected in a manner such that the top panel is connected to the bottom panel by the front side wall, the back side wall, the first side wall and the second side wall; and the front side wall is connected to the back side wall by the top panel, the bottom panel, the first side wall and the second side wall. Each wall of the container has an interior surface and an exterior surface. The interior surface of each of the bottom panel, the front side wall, the back side wall, the first side wall and the second side wall define a chamber for holding absorbent personal care articles. The chamber is capable of holding at least two absorbent personal care articles that are placed within the chamber of the container component. In addition, the container component is devoid of any indicia on the exterior surface of each of the top panel, the front side wall, the first side wall and the second side wall which tends to indicate that the container has at least two personal care articles placed within the container. With these walls and the top panel being devoid of any indicia indicating the contents of the container, the container of the present invention, with its contents of absorbent personal care articles can be left in plain sight without clearly indicating the contents of the container to the user or the non-user.

In a further aspect of the present invention, the container is also provided with an opening device which also aids in the opening and closing of the container.

In another aspect, the present invention also provides a package for personal care products. The package has a container component with an exterior surface, an interior surface and a chamber for holding at least two absorbent personal care articles. Within the chamber is placed a plurality of personal care articles and a plurality of wrapper components wherein each personal care article is contained within a wrapper component and each wrapper component is capable of holding at least one absorbent personal care article. The package of this aspect of the present invention may also contain an inner material component which covers or encircles at least a portion of the absorbent personal care articles and wrapper components placed within the chamber. In addition, the wrapper components, the inner material component, if present, and at least a portion of the exterior surface of the container may each have a color hue, and the predominate color hue on each of the wrapper component, inner material and exterior surface of the container is the same color hue. Further, the interior surface of the container may also have a color hue similar to or the same as the predominate color hue which is present on the inner material component, wrapper and exterior surface of the container.

In an additional aspect of the present invention, consumer information, such as branding and other indicia which indicates that the contents of the container are provided to the consumer by applying an exterior material or overwrap on the container with its contents of absorbent personal care articles.

The package of personal care articles of the present invention resembles a gift and has a gift-like appearance. Receiving a gift is generally a positive experience in a person's life. The package of personal care articles of the present invention provides a link to a positive experience in a person's life during a time of need, particularly when a user needs to use personal care products, such as during a woman's menstrual period. As a result, it is believed that the package of personal care articles can promote an improved emotional state among users during their time of need, by providing a link to a positive experience in a users personal life, in this case, receiving a gift.

DEFINITIONS

Figure 1:
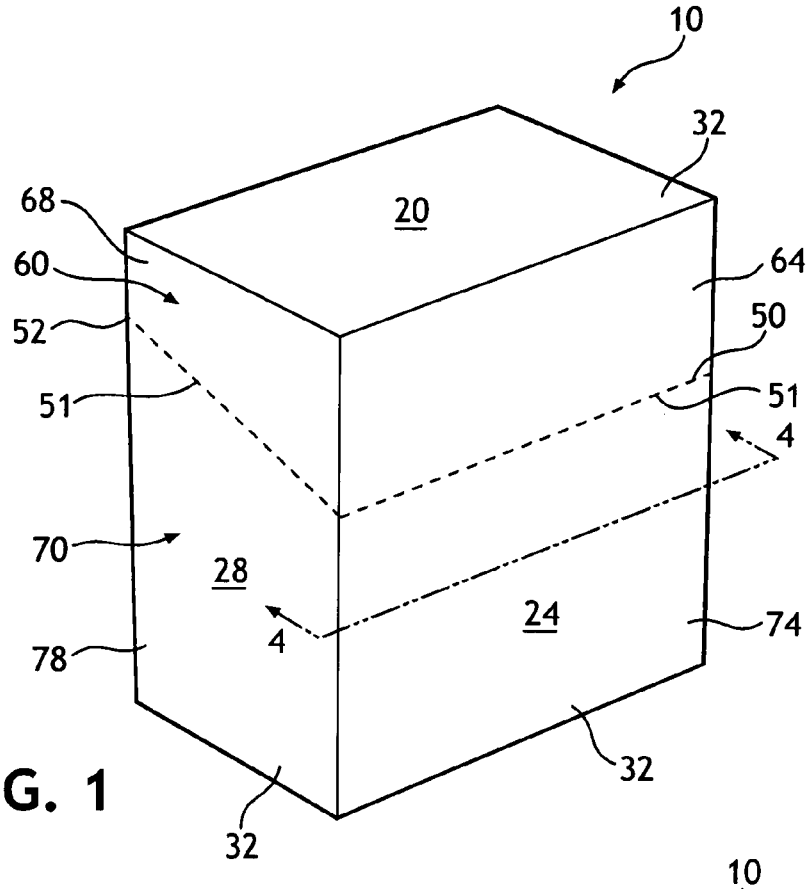
FIG. 1 shows a front perspective view of a representative container of the present invention.

It should be noted that, when employed in the present disclosure, the terms "comprises", "comprising" and other derivatives from the root term "comprise" are intended to be open-ended terms that specify the presence of any stated features, elements, integers, steps, or components, and are not intended to preclude the presence or addition of one or more other features, elements, integers, steps, components, or groups thereof.

It should be understood that the term "personal care product" or "personal care article" as used herein refers to any article used to control bodily fluids, and includes "absorbent products," which refers to any article configured to absorb and retain bodily exudates, including urine, bowel movements, blood and menses, and includes such a product in a packaged and unpackaged configuration. As such, "personal care products" as used herein, includes without limitation, diapers, child toilet training pants, adult incontinence garments, male incontinence products, tampons, vaginal suppositories, panty liners, pads, sanitary napkins, tissues, wipes, etc. For example, personal care products include without limitation Poise® feminine care products, including pantiliners and pads, and Kotex® feminine care products, including sanitary napkins, tampons and liners, all available from Kimberly-Clark Corporation, Neenah, Wis.

The phrase "devoid of any indicia which tends to indicate that the container has at least one absorbent personal care product" is intended to mean that the presence of words, symbols, pictures and other marks which would suggest the possible presence of absorbent personal care product within the container are not present on the defined walls and panels. Examples of indicia intended to be excluded include, brand names, words or phrases normally associated with absorbent articles, such as "liners", "pantiliners", "tampons" and the like, or symbols or pictures which depict such absorbent personal care articles. It is noted that this phrase is not intended to exclude information or indicia, which does not imply the presence of an absorbent personal care article, for example, but not limited to, flowers, patterns, or pictures not associated with absorbent personal care articles, and the like.

As used herein, the phrase "predominate color hue" is intended to mean the color which covers the largest surface area. For example, if a surface has three colors, for example, green, yellow and purple, and green covers 36% of the surface area while yellow and purple each cover 32% of the surface area, then green is the predominate color hue.

As used herein, the phrase, "line of weakness" means an area of a material that promotes or enhances separation of a single or unitary structure into at least two structures, or an area of material that promotes or enhances bending or folding without separation.

As used herein, the phrase "fold crease line" is intended to mean a line or other shape imparted to the structure of a blank material, which facilitates bending of the individual walls, panels and flaps of the blank to allow the blank material to be formed into a container of the present invention.

DETAILED DESCRIPTION OF THE INVENTION

The container component of the present invention may be formed in many different shapes and sizes without departing for the scope of the present invention. For example, the container may have a cylindrical shape, having a single continuous side wall and a top panel and a bottom or may desirably be a parallelepiped shape. Other shapes may be used for the container of the present invention without departing from the scope of the present invention. In any event, at least the top panel and at least one side wall of the container of the present invention is devoid of indicia which tend to indicate that the container has placed therein absorbent personal care articles.

Figure 2:
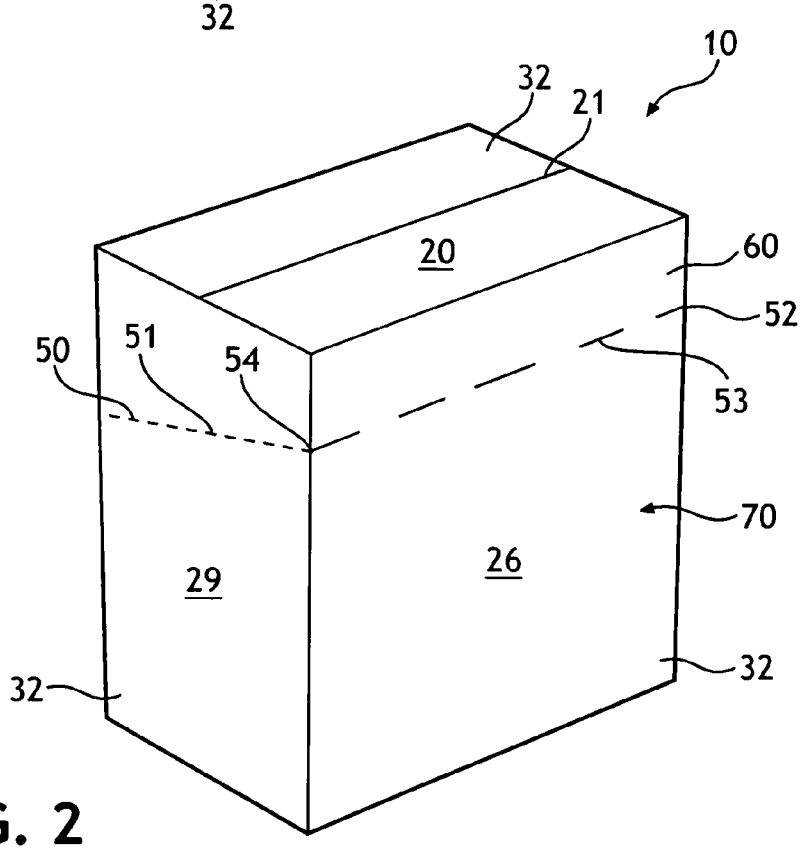
FIG. 2 shows a back perspective view of a representative container of the present invention.
Figure 3:
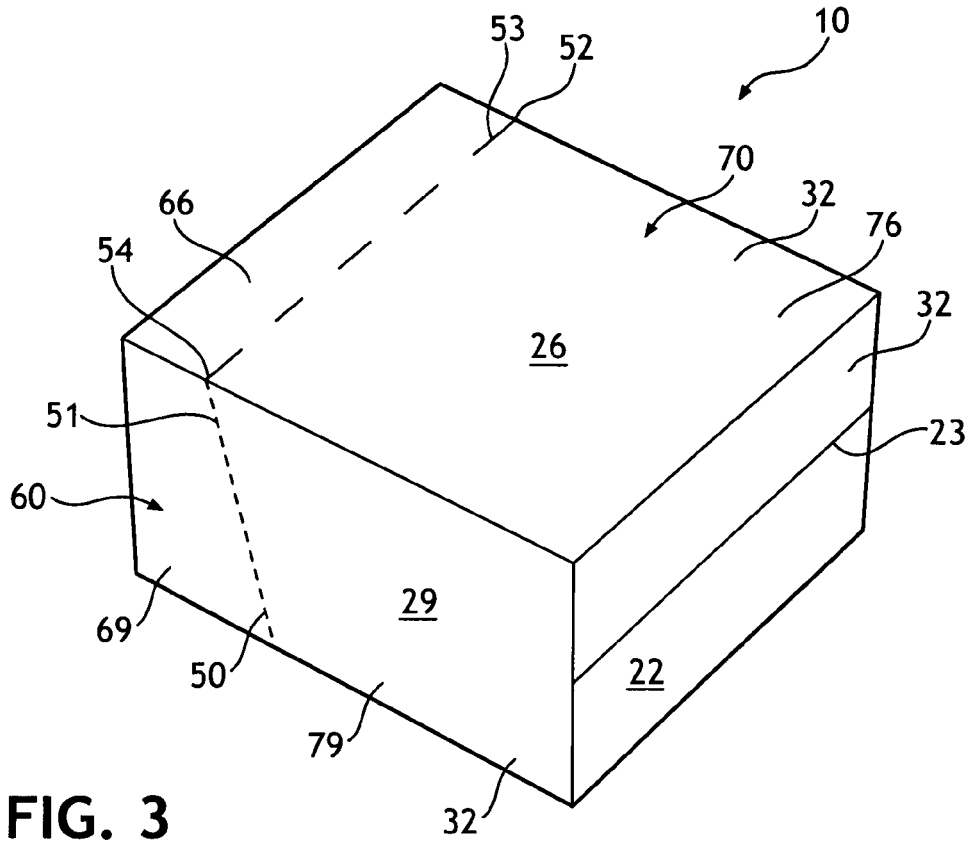
FIG. 3 shows a perspective bottom view of the container component.
Figure 4:
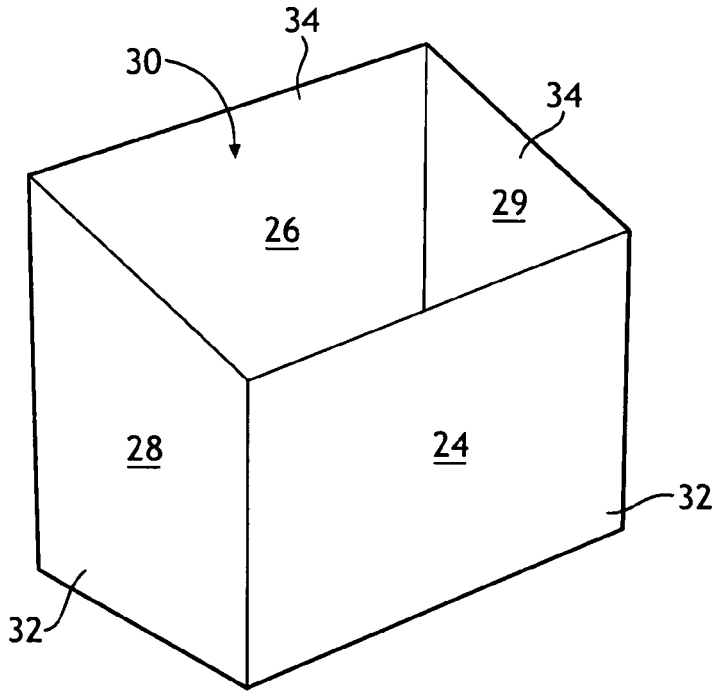
FIG. 4 shows a cut-away perspective view of FIG. 1 along section line 4-4.

To gain a better understanding of the present invention, attention is directed to the FIGS. 1-4. FIG. 1 shows a perspective front view of a representative container component of the present invention in a closed configuration. FIG. 2 shows a perspective back view of a representative container component of the present invention in a closed configuration. FIG. 3 shows a perspective bottom view of the container component in a closed configuration. FIG. 4 shows a cut-away perspective view of FIG. 1 along section line 4-4.

The container component 10 of the present invention has a top panel 20, a bottom panel 22, a front side wall 24, a back side wall 26, a first side wall 28 and a second side wall 29. These walls are connected in a manner such that the top panel 20 is connected to the bottom panel 22 by the front side wall 24, the back side wall 26, the first side wall 28 and the second side wall 29; and the front side wall 24 is connected to the back side wall 26 by the first side wall 28 and the second side wall 29. Each wall of the container component has an interior surface 34 and an exterior surface 32. The interior surface 34 of each of the bottom panel 22, the front side wall 24, the back side wall 26, the first side wall 28 and the second side wall 29 define a chamber 30 for holding a plurality of absorbent personal care articles (not shown in FIGS. 1-4). The chamber 30 of the container 10 is capable of holding at least two absorbent personal care articles placed within the chamber 30.

In one aspect of the present invention, the container component 10 is devoid of any indicia, on exterior surface 32 of each of the top panel 20, the front side wall 24, the first side wall 28 and the second side wall 29 which tends to indicate that the container component 10 has at least one personal care product placed within said chamber 30. Optionally, the exterior surface 32 of the backside wall 26 may also be devoid of any indicia which tends to indicate the container component contains absorbent articles. Likewise, the exterior surface 32 of the bottom panel 22 may also be devoid of any indicia which tends to indicate that the container contains absorbent articles. With these walls being devoid of any indicia indicating the contents of the container is absorbent articles (not shown in FIGS. 1-4), it is difficult for a person not knowing what the contents of the container are to determine the contents of the container without opening the container. As a result, the container, with its contents of absorbent personal care articles may discretely be left in the open, i.e. in plain sight for others to see, without clearly indicating the contents of the container 10.

The container component of the present invention may also have an opening device. By the use of the term "opening device", it is meant some structure which aids a user to open the container and access the absorbent articles contained therein. In addition to providing a means for opening the container component of the present invention, the opening device may also provide a means for closing the container component after opening. For example, the opening device may be a flap on the container which allows the user to grip the container. The flap may also be used to close the container by inserting the flap into a slot found on the container near where the opening device comes into contact with the container. Other types of opening devices which may be used in the present invention include a removable lid or a hinged lid (a flip top lid). By having a means for opening and closing the container component, the absorbent personal care articles within the chamber of the container component are kept clean. Further, the opening device/closing device or feature also improves the discretion provided by the container component. That is, by closing the container it is difficult for a person to see what is in the container when the container is in a closed position. Having both the opening device/closing feature on the container, coupled with the lack of indicia on the container which tends to indicate the presence of absorbent personal care articles, provides for a package which is difficult to determine what is inside, without opening the container, thereby providing a container which provides discretion.

Figure 5:
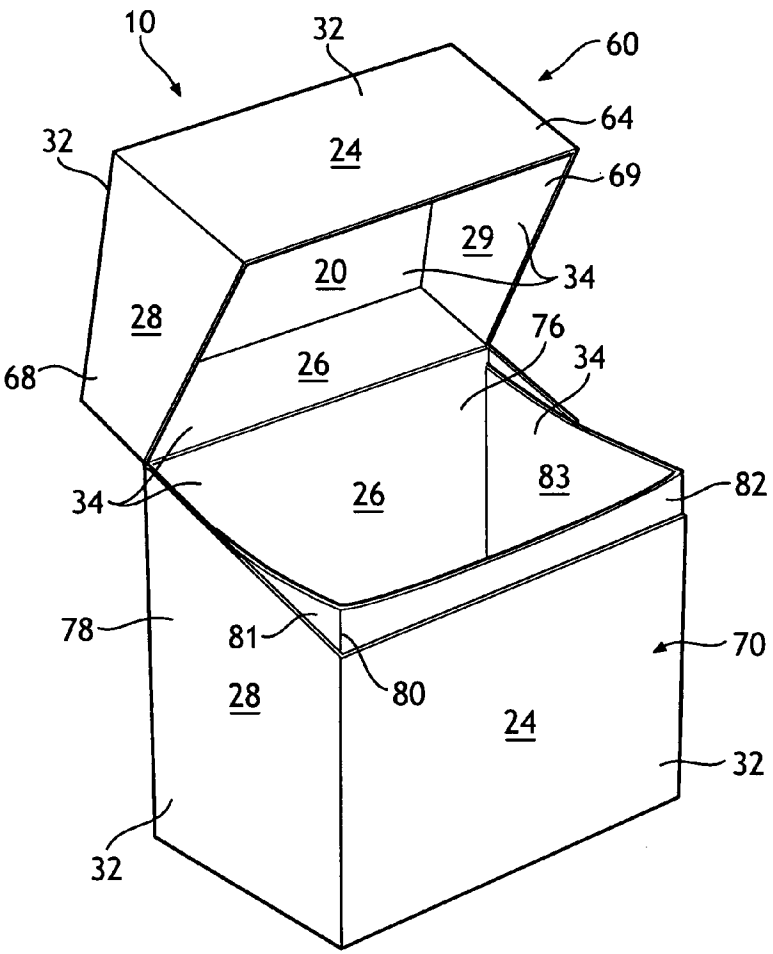
FIG. 5 shows a front perspective view of the container component with a opening device and an interior panel.

In the present invention, desired opening devices provide for a container with a removable lid or a hinged lid. To obtain a better understanding of this feature, attention is again directed to FIGS. 1-3 and FIG. 5. The opening device 50 divides the container component 10 into a top section 60 and a bottom section 70. The top section 60 forms a lid type structure, as is shown in FIG. 5. The top section encompass the top panel 20, at least an upper portion 64 of the front side wall 24, an upper portion 68 of the first side wall 28 and an upper portion 69 of the second side wall 29. The bottom section 70 encompasses the bottom panel 22, at least a lower portion 76 of the back side wall 26, a lower portion 78 of the first side wall 28 and a lower portion 79 of the second side wall 29. Optionally, and as shown in the FIGS, the top section may contain an upper portion 66 of the backside wall 26 and the bottom section may contain a lower portion 74 of the front side wall 24.

In this configuration, the opening device may be a first line of weakness 51 of starting at a location on the first side wall 28 at a first point 52 located along the edge created where the first side wall 28 intersects the back side wall 26. This line of weakness 51 extends from a first point 52 to the front side wall 24, continues across the front side wall 24 and to the second side wall 29, ending at a location on the second side wall 29 at a second point 54 located along the edge created where the second side wall 29 intersects the back side wall 26. A second line of weakness 53 extends along the back side wall 26 from point 52 to point 54. The first line of weakness 51 should promote or enhance separation of the upper portion 68 from the lower portion 78 of the first side wall 28, the upper portion 64 from the lower portion 74 along the front side wall 24 and the top portion 69 from the lower portion 79 of the second side wall 29. The second line of weakness 53 may be one which promotes separation of the top portion 66 from the bottom portion 76 of the back side wall 26 or one which promotes bending or forms a hinge type structure. When the second line of weakness promotes separation, the top section 60 may become a removable lid. When the second line of weakness promotes bending, the top section 60 becomes a hinged lid and pivots along the second line of weakness 53. If the top section 60 of the container 10 is removable, it is desirable that the top section 60 be repositionable on the bottom section 70, so that the top section and bottom section can together effectively close the container.

The lines of weakness are shown in the figures to be straight lines. However, it is not necessary for the lines of weakness to be straight. Other possible configurations for the lines of weakness include, for example, gently curving lines, zig-zag lines, sinusoidal lines and the like. The only limitation to the shape of the lines of weakness is if the line of weakness is intended to form a hinge structure, the line of weakness should be straight. Gently curving lines can provide a more feminine flair to the container.

Lines of weakness which promote separation can be prepared using known methods, including mechanical means such as embossing, scoring, and cutting, and other means such as etching, lasers, heat or combination of any of the foregoing methods. It is desired in the present invention to create the line of weakness by creating a line of alternating cuts and lands. If the land area is relatively small to the cut area, the lands will tend to tear when a force is applied. This configuration is referred to in the art as perforations. Lines of weakness which promote bending may be imparted by any method used for promoting separation, but care is used not to create a structure which will tend to separate rather than bend. One example is to have alternating lands and cuts, wherein the land area is generally larger than cut area.

Other configurations for the lid of the container may be used without departing from the scope of the present invention. For example, the second line of weakness 53 may be located at the point where the back side wall 26 and the top panel 20 intersect, such that the top portion of the container does not include any of the back side wall. Alternatively, the second line of weakness 53 may be located at the point where the back side wall 26 and the bottom panel 22 intersect, such that the top portion of the container includes the entire the back side wall 26. Similarly, the first line of weakness 51 on the front side wall may be as low as the intersection of the bottom panel 22 and the front side wall 24 and as high as the intersection of the top side wall 20 and the front side wall 24. The actual location of the lines of weakness 51 and 53 are not critical to present invention. It is desired that the top portion of the front wall 24 is less than about 50% of the area of the front side wall, and more desirably between about 20 and 45% of the area of the front side wall. It is also desired that the top portion of the back side wall is between 5 and 40% of the area of the back wall, and more desirably between 15 and 30% of the area of the back wall.

The actual configuration of the lines of weakness is not critical to the present invention. The size of the land and slits can be determined by those skilled in the art and generally depend on factors such as the material used in the construction of the container component, the size and shape of the container component, the weight of the absorbent articles placed in the container component, among other considerations. As a general rule, for a line of weakness which will allow separation of one portion from another, the length of the lands should be less than about 25% of the length of the slits. Desirably, the length of the lands should be in the range of about 10% to 20% of the length of the slits. As an example, if the lands are about 1 mm each, the length of the slits should be between about 5 mm and about 10 mm in length. The maximum length of the lands is dependant on material used to form the container. On the other hand, if the lines of weakness are land and slits and the line of weakness is intended to be used as a hinge, the lands are generally about 50% to 150% of the length of the slits. The maximum length of the lands is again dependent on the material used to form the container.

In addition, other means of forming a hinge type structure may be used in the present invention to obtain a top section 60 which pivots relative to the bottom section 70. The top section and the bottom section of the container could be separate and hinged using a connecting means such as tape.

The container component may also have at least one interior panel 80 placed within the chamber 30, as is shown in FIG. 5. In one configuration, the interior panel 80 at least contacts the interior surface 34 of the front side wall 24. In the alternative, there may be two interior panels (81, 83) placed within the chamber 30, wherein one of the two panels 81 contacts the interior surface of the first side wall 28 and the other of the two panels 83 contacts the interior surface of the other side wall 29. In a desired configuration, there is one interior panel which has three sections. A first section 81 which contacts the interior surface of the first side wall 28, a second section 82 which contact the interior surface of the front side wall and a third section 83 which contacts the interior surface of the second side wall 29. The first and third sections of the interior panel 81 and 83 are connected to each other by the second section 82.

Generally, the interior panel extends beyond the height of the lower portion 74 of the front side wall 24, whether a panel is attached to the interior surface of the side walls or the interior surface of the front side wall. The interior panel is an optional component of the container, but it provides the container with greater rigidity. In addition, the interior panel 80, when present, provides support for the lid by providing a shoulder for the lid to rest against when the lid is closed. The panel helps the lid keep its shape while in the closed position and provides the lid with a stopping point when closing the lid.

The interior panel can have any shape, including straight edges, lines similar to that formed by the opening device, or curved shapes. If a curved shape is used, it is generally desired that the interior panel, where it meets the corners of created by the front side panel 24 and the first and second side panels 28, 29, is higher than the middle portion 82. An example of this configuration is shown in FIG. 5. Other curved shapes may be used without departing from the scope of the present invention.

The container component of the present invention is not restricted in its size. Generally, the container component will be appropriately sized depending on factors such as type of absorbent article placed into the container, and the number of absorbent articles. Larger absorbent articles and higher numbers of absorbent articles require larger containers. For example, a container component containing sanitary napkins would have to be larger than a container component containing pantiliners, assuming that there are a similar number of each article.

The container component of the present invention may be formed from any material known to those skilled in the art which are typically used to prepare packaging materials. For example, the package can be a carton formed of a rigid material such as cardboard, paperboard, plastic including molded plastic and the like. Other packaging materials include flexible packaging such as flexible bags. Generally, flexible bags are formed from a thin material, such as paper, plastic, or a laminate of two or more of these materials. In the present invention, it is generally desired to use paperboard as the material to prepare the container.

The container component may be a molded article, made form several different pieces of the container material or the container may be prepared from a unitary piece of material, without departing from the scope of the present invention. If the container is prepared from several different pieces of material, the pieces may be held together using any suitable means, such as adhesives, staples and the like. From the standpoint of ease of construction and cost, it is desirable to prepare the container from a unitary piece of material, generally paperboard.

Figure 6:
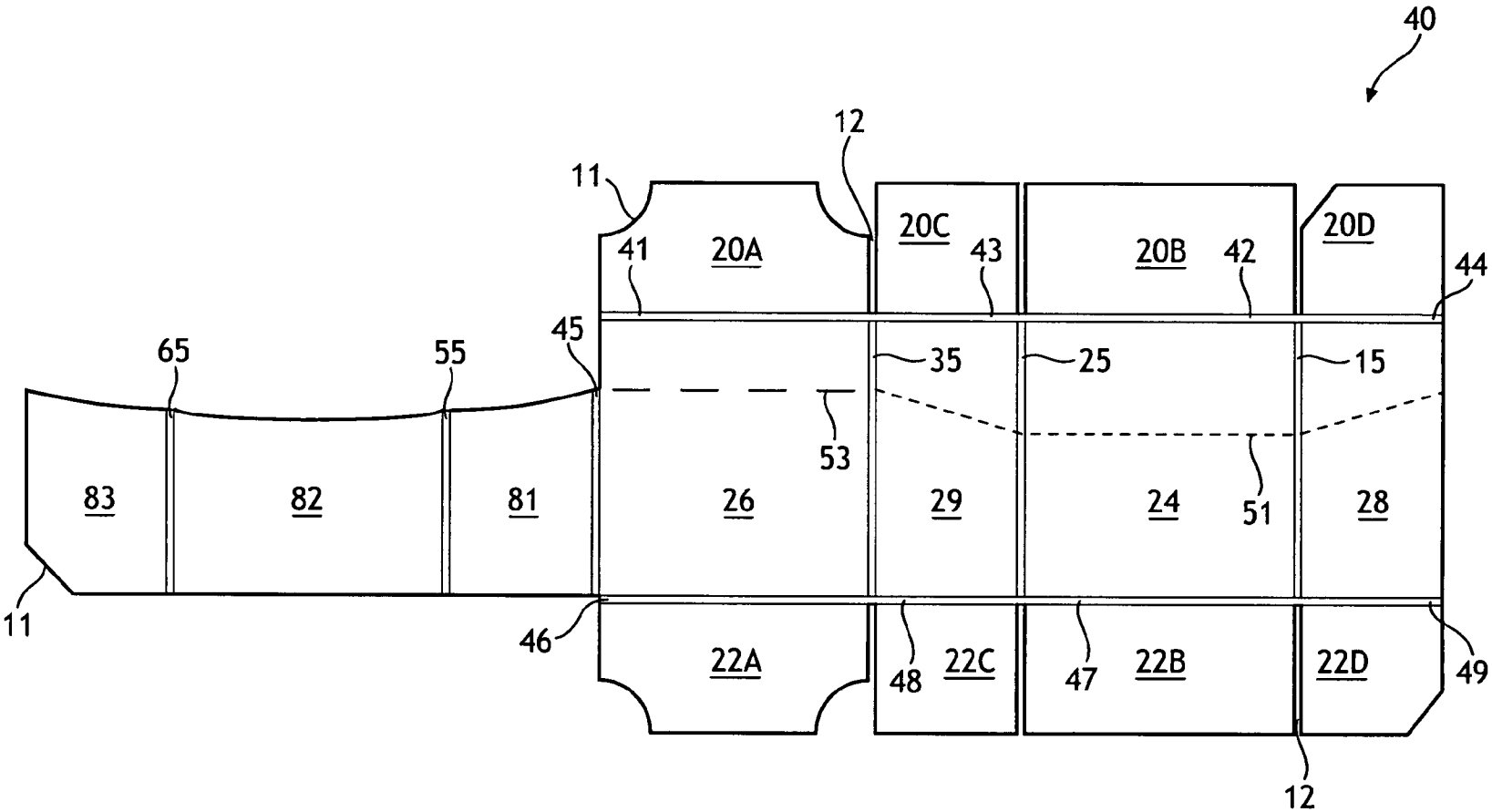
FIG. 6 shows a plan view of an unitary blank which may be used to form the container component of the present invention.

FIG. 6 shows an exemplary unitary blank 40 which is suitably perforated and scored to form a container 10 (shown in FIGS. 1-3 and 5) with a three-sided interior panel. The unitary blank 40 has a front side wall 24 which is separated from the first side wall 28 and the second side wall 29 by fold crease lines 15 and 25, respectively. The second side wall 29 is separated from the back side wall 26 by a fold crease line 35. The back side wall 26 is separated from the first section of the interior panel 81 by fold crease line 45. The first section of the interior panel 81 is separated from the second section of the interior panel 82 by fold crease line 55. The second section of the interior panel 82 is separated from the third section of the interior panel 83 by fold crease line 65.

The top panel 20 of the container 10 is formed from flaps 20A, 20B, 20C and 20D. Flap 20A is separated from the back side wall 26 via fold crease line 41. Flap 20 B is separated from the front side wall 22 via fold crease line 42. Flap 20C is separated from the second side wall 29 via fold crease line 43. Flap 20 D is separated from the first side wall 28 via fold crease line 44.

In a similar manner to the bottom panel 22 of the container 10 is formed from flaps 22A, 22B, 22C and 22D. Flap 22A is separated from the back side wall 26 via fold crease line 46. Flap 22 B is separated from the front side wall 22 via fold crease line 47. Flap 22C is separated from the second side wall 29 via fold crease line 48. Flap 22 D is separated from the first side wall 28 via fold crease line 49.

The first and second lines of weakness 51, 53 may also be formed in the unitary blank 40, prior to formation of the container from the blank. These lines of weakness and the fold crease lines may be formed into the unitary blank using any known method.

In addition, recesses 11 or slots 12 may optionally be included in the blank 40 at the corners where walls and panels tend overlap. These recesses and slots allow for stress relief when the container is formed, making it easier to form the container. In a similar manner, the flaps may be tapered to aid in the formation of the container.

From the unitary blank 40, the container may be formed by the following procedure. The fold crease lines separating the sides and the interior panel are folded one at a time starting with fold crease line 65. Fold crease line 65 is folded such that the third interior panel 83 and the second interior panel 82 are at a right angle to each other. Next fold crease line 55 is folded such that the first interior panel 81 is parallel to the third interior panel 83 and the second interior panel is at a right angle to the first interior panel 81. Fold crease line 45 is then fold such that the end 84 of the third interior panel will come into contact with or will be adjacent the interior 34 of the back side wall 26 near the fold crease line 35. As a result, the second interior panel 82 and the back side wall 26 will be parallel to each other. Next an adhesive, or other attachment means may optionally be applied to the interior surface 34 second side wall 29 or the surface the third interior panel 83 which will come into contact with the second side wall 29 when fold crease line 35 is folded. Fold crease lines 35 and 25 each folded such that the interior surface 34 of the second side panel 29 will come into contact with the third interior panel 83 and the interior surface 34 of the front side panel 24 will come into contact with the second interior panel 82. An adhesive or other attachment means may be applied to the interior surface 34 of the first side wall 28 which will come into contact with the first interior panel wall 81. Fold crease line 15 is then folded such that interior surface 34 of the first side wall 28 is in contact with the first interior panel. After this fold is made, the sides of the chamber 30 and container 10 are formed. Other attachment means include, for example, applying tape like material on the exterior surface 32 of the first side wall 28 to the back side wall 26 over the seam created fold crease line 45 and the edge 85 of the first side wall 28.

After the sides of the container 10 are constructed, next the bottom and the top panels 22 and 20 are formed, from the flaps. It does not matter in the present invention if the top panel or the bottom panel is first formed; however, the description of forming the container will be described in terms of first forming the bottom panel.

The bottom panel is formed by folding flaps 22C and 22D inward towards the interior surface 34 of the chamber 30. Next, flap 22A is folded inward overlapping flaps 22C and 22D. An adhesive or other attachment means may be used to hold the flaps in place. Finally, flap 22 B is folded over flap 22A and flaps 22 C and 22 D. Prior to folding flap 22B an adhesive or other attachment means may be applied to a portion or all of the overlapping portions of the flap 22B where it overlaps flaps 22A, 22C and 22D.

In a similar manner, the top panel is formed by folding flaps 20C and 20D inward towards the interior surface 34 of the chamber 30. Next, flap 20A is folded inward overlapping flaps 20C and 20D. An adhesive or other attachment means may be used to hold the flaps in place. Finally, flap 20 B is folded over flap 20A and flaps 20 C and 20 D. Prior to folding flap 20B an adhesive or other attachment means may be applied to a portion or all of the overlapping portions of the flap 20B where it overlaps flaps 20A, 20C and 20D.

Prior to forming the top panel or the bottom panel, which ever is last formed, the absorbent articles should by added to the container component 10. Also, by forming the container in the manner described above, the top panel with have an edge 21, shown in FIG. 2 and the bottom panel will have an edge 23, shown in FIG. 3. Any other configuration of the container component may be used in the present invention without departing from the scope of the present invention.

Suitable adhesives which may be used in the present invention to hold the container together include, hot melt adhesives, cold glue adhesives, solvent type adhesives and any other types of adhesive know to those skilled in the art. The adhesives may be applied using known methods, including, for example, spraying, rolling, slot coating and the like. Alternative attachments means usable in the present invention include, for example, tape, staples, heat sealing and the like.

In the present invention, the container may also have an inner material placed within the chamber of the container. This inner material helps to convey the gift-like features of the present invention since gifts are often further wrapped inside of a box or bag with a material to improve the presentation of the gift. Materials which may be used as the inner material include, for example, a plastic film, a foil, a woven or knitted fabric, a piece of paper, a nonwoven material or a tissue type of material. Each of these materials may contain a surface effect which may be imparted to the material by printing, embossing or laminating materials together. Surface effects include, for example, printed or embossed patterns, holographic effects and the like. Desirably, the material is tissue paper, which provides cost advantage over the other materials. In addition, by using tissue paper, an emotional benefit may be provided to a user, since tissue paper is often used as an inner wrapper of gifts. There may be more than one inner material used, and the inner material can be in the form of other gift related items such as ribbons, and bows.

Figure 7:
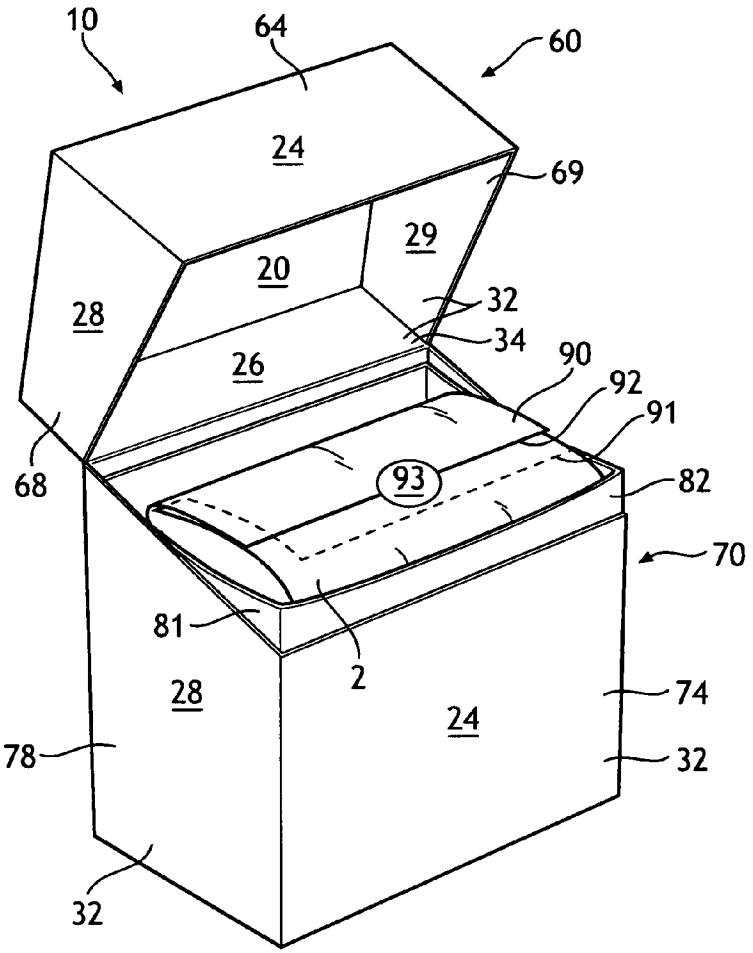
FIG. 7 shows a perspective view of the container of the present invention with an inner material in a closed position.
Figure 8:
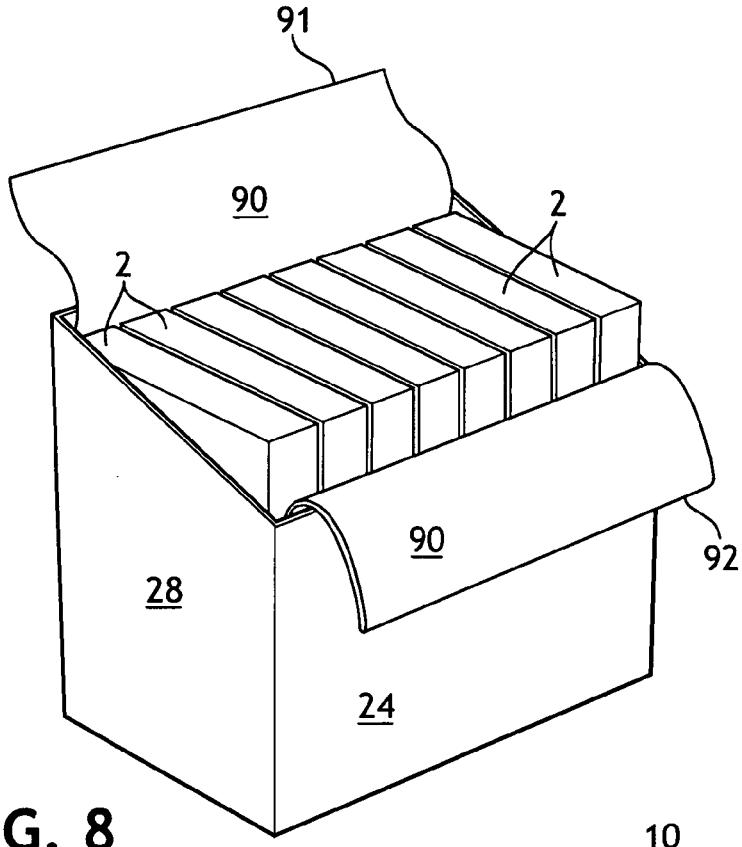
FIG. 8 shows a perspective view of the container of the present invention with an inner material in an open position.

In the present invention, the inner material may be cut sheet of a material which lies on top of the absorbent personal care articles, such that the ends of the material do not overlap one another or the inner material is of a length such that the inner material encircles the absorbent personal care articles. In this regard, attention is directed to FIGS. 7 and 8. As is shown in FIG. 7, the inner material 90 encircles the absorbent articles 2 placed with the chamber 30. This inner material 90 has a first end 91 and a second end 92, the material encircles the absorbent personal care articles 2 such that the first and second ends overlap each other. Desirably, the second end 92 may overlap the first end 91. The overlap should be at a location in which it is easy for the user of the absorbent personal care articles 2 to manipulate the inner material 90 so that the absorbent personal care article can be easily removed from the container. Generally, the overlap of the inner material is towards the front side wall or the top panel of the container. The overlapped first end 91 and second end 92 may be held in place using an adhesive means such as applying an adhesive to the inner material near one of the ends. In another possible embodiment, the ends of the inner material may be held together by a removable and reattachable means, such as a pressure sensitive tape 93. Desirably, from an aesthetic point of view and to further convey the gift-like features of the present invention, the reattachable means is in the form of a sticker, which is has a pressure sensitive adhesive on the side which contacts the inner material. The outer surface side of the sticker, the side opposite the pressure sensitive adhesive, desirably has some sort of aesthetic value. The outer surface may be coordinated with the inner material, having a similar hue to the inner material, or a pattern in which a one portion thereof has a color of the same hue. In the alternative, the sticker may contain a pattern having a complementary color or be a solid complementary color. In one example, the sticker may have a gold color on the outer surface. The sticker will provide the user with a use experience that resembles opening of a gift, and thereby may provide a positive emotional benefit to the user by associating the container of personal care articles with a gift, thereby invoking positive memories in a user's life.

Typically, the inner material 90 within the chamber of the container will encircle at least a portion of the absorbent personal care articles placed within the chamber. Desirably, inner material 90 will encircle at least 50 percent of the personal care articles 2 with in the chamber 30, more desirably, at least 75 percent of the personal care articles, an most desirably, essentially all of the personal care articles 2 within the chamber are encircled by the inner material 90. By having all of the absorbent articles encircled by the inner material 90, even if the lid or top section 60 of the container 10 is opened by someone who is not the intended user of the personal care articles, the contents of the chamber 30 will still be hidden from view, without some additional effort. Therefore, the inner material 90 may provide another layer of discretion protection to the intended user, allowing the container to be left in plain sight of others. Further, the inner material 90 may protect the absorbent articles 2 from becoming soiled or dirty from repeated opening of the lid or top section 60 of the container 10. At the option of the user, the inner material 90 may be removed from the container 10, to improve access to the absorbent personal care articles.

In alternative embodiment, groups of less that all of the absorbent personal care articles placed in the container can be covered by or encircled with separate pieces of the inner material. For example, if a package contains 21 absorbent personal care articles, three groups of seven absorbent personal care articles may be covered by or encircled with the inner material. The actual number of absorbent articles contained in each group or the number of groups within a given container are not critical to the present invention.

In the present invention, since the package does not contain any indicia of the contents of the container on the exterior surface of at least one side wall and the top panel and more particularly of the front side wall, the top side wall and the two side walls, and optionally the back side wall, in order to convey to the consumer the contents of the container prior to purchase and to make the container suitable for sale, the exterior surface of the bottom panel and optionally the exterior surface of the back side wall may be provided with such indicia. The indicia include, for example, branding, any trademarks, bar codes, product descriptions, instructions for the use of the product, instructions for opening the container, manufacture contact information and the like. All such indicia tend to indicate what the contents of the container are. Desirably, the exterior surface of the back side wall does not contain such indicia.

As an alternative to placing all of such information on the exterior surface on the bottom, an additional piece of material, hereinafter referred to as the "outer material" or "overwrap" may be use to convey the necessary information to the consumer. This outer material could contain all of the necessary indicia mentioned above. The outer material should be removable from the container by the consumer without damaging the exterior surface of the container. The outer material may be held in place to the container by any means, including using an adhesive, tape, tension and the like, provided that the means to hold the additional material to the container does not damage the container when the outer material is removed. The outer material may be in the form of a sticker, a booklet, a tag, a shrink film, a band of a material and the like.

Figure 9:
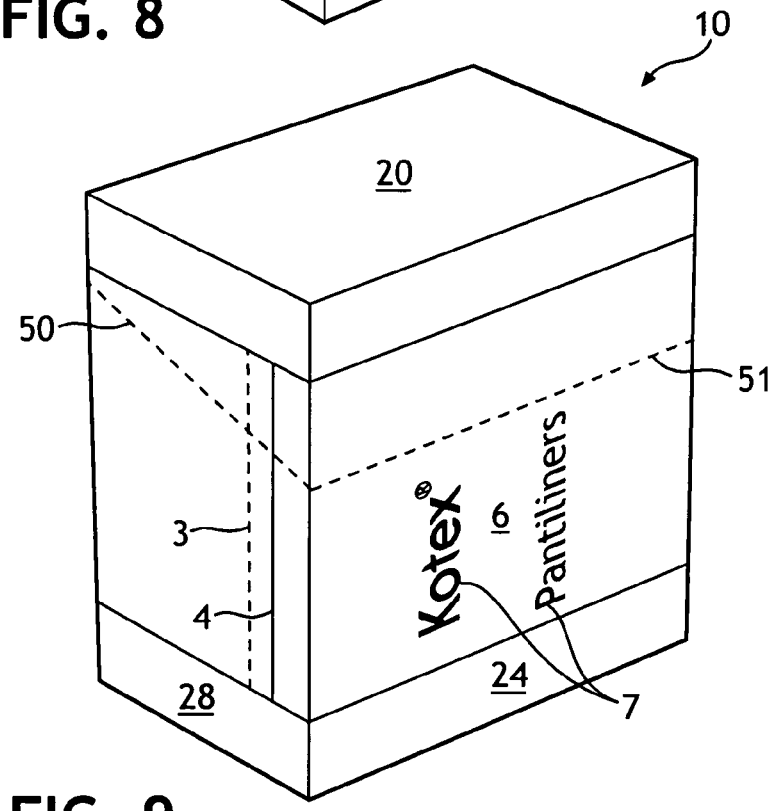
FIG. 9 shows a front perspective view of a representative container of the present invention with an overwrap.

To gain a better understanding of the overwrap, attention is directed to FIG. 9, which shows a containers 10 of the present invention with an overwrap or outer material 6. The outer material 6 may cover at least a portion of at least one exterior surface of one of the walls which do not contain any indicia that tends to indicate the contents of the container. Desirably, the outer material 6 may cover at least a portion of the exterior surface of the outer surfaces of at least two walls of the container component. Most desirably, the outer material 6 may cover at least a portion of the exterior of at least four walls of the container component. As used herein, the term "cover" is intended to mean that the surface under the material, whether or not the material is in contact with the surface. Stated another way, the material may or may not be in contact with the surface in which the material covers.

It is also noted that the outer material may be a single piece of material or several individual pieces. Desirably, the outer material is a single piece of material. Generally, the outer material is printed or embossed with the indicia 7, wherein the indicia include items such as branding, instructions, bar code and the like. The outer material 6 may be in the form of a sleeve which encircles the container, as is shown in FIG. 9. The outer material has a first end 3 and a second end 4 where the first end and second end are generally adjacent each other when the material encircles the container, or the first or second end overlaps the other as is shown in FIG. 9. In the present invention, it is desirable that the first and second ends 3, 4 of the overwrap 6 overlap each other and that an adhesive is used to hold the two ends together. Also, as is shown in FIG. 9, it is desirable that the overwrap 6 cover at least a portion of each side wall of the container 24, 26, 28 and 29, and it is desirable that the back side wall 26 does not contain any indicia tending to indicate what the contents of the container 10 are.

The outer material or overwrap 6 may be prepared from a wide variety of material including, for example, paperboard, tissue, polymer film, a nonwoven material, shrink film, a shrink band and laminated structures, such as laminated film materials, and the like. Desirably, the outer material is a polymer film, which is printed with the indicia which tends to indicate the contents of the container.

Although the container is devoid on any indicia the exterior surface of the top panel, front side wall, first side wall, second side wall and optionally the back side wall and the bottom panel, which tends to indicate the presence of absorbent personal care articles does not mean that the container is devoid of all graphics. Pictures and designs unrelated to personal care articles may be present on the exterior surface of the container. In addition, the interior surface of the container, especially the interior surface of the top panel may be imparted with information of how to use the personal care products placed within the container or other information, such as words of inspiration to the user of the personal care products. One way of conveying needed information to the user includes placing an insert in the container with instructions how to use the products.

To open the container 10, the overwrap 6, if present, is removed from the container component 10. Next, the line of weakness 51 is broken, by the user by, for example, pushing the lower portion 74 of the front side wall 24 below the line of weakness 51 inward, which will cause separation of the top section 60 from the a bottom section 70. The separation will allow the user to grip the upper portion of the front side wall 24, thereby allowing the user to separate the lands of the line of weakness 51. The first line of weakness 51 also provides another benefit to the user as a tamper evident seal. If the lines of weakness 51 are broken prior to the user opening the container, it would tend to indicate to the user that the contents of the container may have been compromised. The lines of weakness 51 also tend to give an audible signal to the user that the container is being opened for the first time. If the second line of weakness 53 forms a hinge, the top section of the container 60 will pivot relative to the bottom section 70 along the second line of weakness 53. If the second line of weakness 53 is designed to be separated, the top section 60 of the container 10 may be removed from the bottom section 70. If an inner material is provided, the inner material may have to be moved or removed by the user to remove an absorbent article from the container 10.

The absorbent article which may be placed in the chamber of the container of the present invention may be any absorbent article including, for example, feminine napkins (sanitary napkins) pantiliners, tampons, interlabial pads, other feminine care products, adult care products, child care products and infant care products. Although the absorbent article will be further described below in terms of a pantiliner or pads, modifications can be easily made by those skilled in the art to use the teachings herein to other absorbent personal care articles.

Absorbent articles such as, for example, feminine care and incontinent absorbent products, generally include a liquid pervious topsheet, a substantially liquid impervious backsheet, and an absorbent core positioned and held between the topsheet and the backsheet. The topsheet is generally operatively permeable to the liquids that are intended to be held or stored by the absorbent article, and the backsheet may be substantially impermeable or otherwise operatively impermeable to the liquids intended to be held or stored. Disposable absorbent articles may also include other optional components or layers, such as liquid wicking layers, liquid distribution layers, barrier layers, and the like, as well as combinations thereof, which may improve the fluid handling and storage properties of the disposable absorbent article. Generally, disposable absorbent articles and the components thereof provide a body-facing surface and a garment-facing surface. As an alternative, the substantially liquid impervious backsheet may be replaced with a liquid pervious backsheet, when the absorbent personal care product is used in conjunction with another liquid impervious layer or article, such as, for example liquid impervious pants. Absorbent articles are exemplified in numerous U.S. Patents and patent applications, including, U.S. patent application Ser. No. 10/379,942, entitled "Perimeter Embossing in an Absorbent Article" filed Mar. 4, 2003; U.S. patent application Ser. No. 10/392,116, entitled "Multilayer Absorbent Article, filed Mar. 19, 2003; and U.S. patent application Ser. No. 10/753,974, entitled "Low Profile Absorbent Pantiliner" filed Jan. 7, 2004, all of which are hereby incorporated by reference in their entirety.

Figure 10:
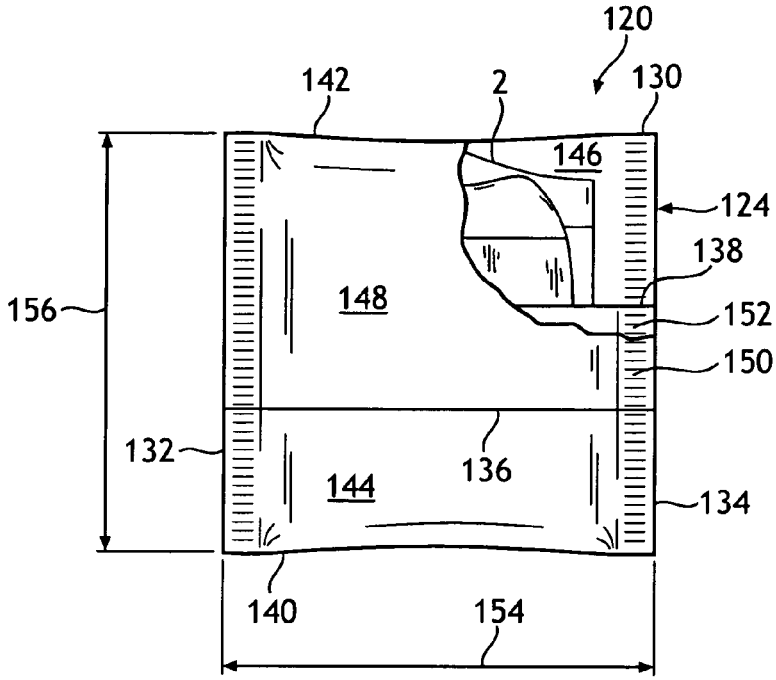
FIG. 10 shows a plan view of a wrapper and absorbent article combination which may be placed within the container of the present invention.

The absorbent articles of the present invention may be placed into the interior volume of the packaging component 10 without being further wrapped in an additional component. In the alternative, the absorbent articles may be wrapped in a wrapper component. The wrapper component may have a number of different configurations without departing from the scope of the present invention. Referring to FIG. 10, a conventional individually wrapped absorbent article is designated in its entirety by the reference numeral. Although the absorbent article shown in FIG. 10 is a pantiliner surrounded by a wrapper, generally designated by 124, those skilled in the art will appreciate that other absorbent articles may be placed in the container component of the present invention.

The absorbent article 2 shown in FIG. 10 is folded twice in a conventional manner to present a generally flat and generally rectangular article. Although the folded pantiliner may have other sizes without departing from the scope of the present invention, in one embodiment the folded liner has a width of about 50 millimeters, a length of about 70 millimeters and a thickness of about 5 millimeters. It is also envisioned that the absorbent article 2 may be unfolded and/or non-rectangular without departing from the scope of the present invention.

Although the wrapper 124 may be made in other ways without departing from the scope of the present invention, in one embodiment the wrapper includes a rectangular sheet 130 having opposing side edges 132, 134 and opposite end edges 136, 138. A first fold 140 in the sheet 130 extending between the side edges 132, 134 forms a bottom of the wrapper 124, and a second fold 142 in the sheet extending between the side edges generally parallel to and above the first fold forms a top of the wrapper. The first fold 140 separates a middle portion 144 of the wrapper 124 from a back portion 146, and the second fold 142 separates the middle portion from a front portion 148 of the wrapper. The side edges 132, 134 of the middle portion 144 are joined to the back portion 146, and the side edges of the forward portion 148 are joined to the middle portion to form opposing sides of the wrapper. A margin 150 of the sheet 130 adjacent the end edge 136 overlaps a margin 152 of the sheet adjacent the end edge 138. It is envisioned that it may be desirable to join the side edges 132, 134 of the forward portion 148 to the back portion 146.

Although the side edges 132, 134 of the rectangular sheet 130 may be joined in other ways (such as with adhesives or by heat sealing) without departing from the scope of the present invention, in one embodiment the side edge margins are joined by conventional mechanical fastening means as shown. Although the wrapped article 120 may have other sizes without departing from the scope of the present invention, in one embodiment the article has a width 154 of about 75 millimeters, a length 156 of about 75 millimeters and a thickness 158 (FIG. 10) of about 5 millimeters. Further, although the dimensions of the article 120 may vary from article to article without departing from the scope of the present invention, in one embodiment the dimensions are generally uniform. In addition, the dimensions may vary within a given article or they may be invariant without departing from the scope of the present invention. Although the wrapper 124 may be made of other materials without departing from the scope of the present invention, in one embodiment the wrapper is made from low density polyethylene sheet material having a thickness of about 38 microns. It is further envisioned that the wrapper 124 may have an adhesive or other closure (not shown) without departing from the scope of the present invention.

One product/wrapper configuration is shown in U.S. Pat. No. 6,601,706 to McManus et al., which is hereby incorporated by reference. Other wrapper/absorbent product configurations are described in, for example U.S. Patent Application Publication 2002/0079246 to Ling et al., which is hereby incorporated by reference.

In another aspect of the present invention, the exterior surface 32 of the container, the interior surface 34 of the container, the interior panel 80, the inner material 90, the wrapper 120 and/or the overwrap 6 may all be coordinated to give an overall finished product appearance. For example, a color or pattern on the exterior container 10 could be used on the inner material 90, the wrapper 120, and/or the interior surface 34 of the container 10. It is noted that not all of these components, if present, need to be coordinated, however, it is desired that all of these components are coordinated. If color is used to coordinate the components of the package, the color used to coordinate is desirably the predominate color hue. It is also desirable not to use white as the coordinating color hue. Other ways of coordinating the outside of the container with the inner may also be used, including coordination with the absorbent article. Indicia, such as patterns, symbols and the like other than indicia which tends to indicate the presence of an absorbent article found on the absorbent article may be placed on the container or other parts of the packaging. In addition, the absorbent articles placed within the container or the container itself may be scented with a fragrance.

Many fragrances have colors associated with the fragrance. For example, the color lavender or purple is often associated with a lavender scent; the color yellow is often associated with a chamomile scent, a daffodil and the like; the color red is often associated with a rose scent and the like; and the color green is often associated with the scents of aloe, wintergreen and the like. Other color and scent combinations may be utilized in the present invention.

In an embodiment of the present invention, the outer surface 32 of the container 10 may have a color hue and the chamber 30 or the absorbent articles 2 within the chamber 30 may have a fragrance associated with the color hue. For example, if a color hue of the outer surface, desirably the predominate color (the color which covers the most surface on the exterior surface of the container), is purple or lavender, then scent within is lavender. If the predominate color hue is yellow, the scent is chamomile, and if the predominate color hue is green, the scent is aloe. However, it is desired in the present invention that a portion of the outer surface of the walls of the container comprises a color hue which is associated with said scent. By providing a coordinated color and scent, there may be some emotional benefit provided to the users of the absorbent articles.

In addition to having the scent associated with the predominate color on the exterior surface 32 of the package, the inner material 90 wrapper and the overwrap 6 may also contain or are the same predominate color hue of the exterior surface of the package. Similarly, the interior surface 34 of the container 10 may also contain or is the same color hue of the exterior surface of the package. By having the interior surface of the container having a similar or the same predominate color hue, an overall gift experience may be created.

Figure 11:
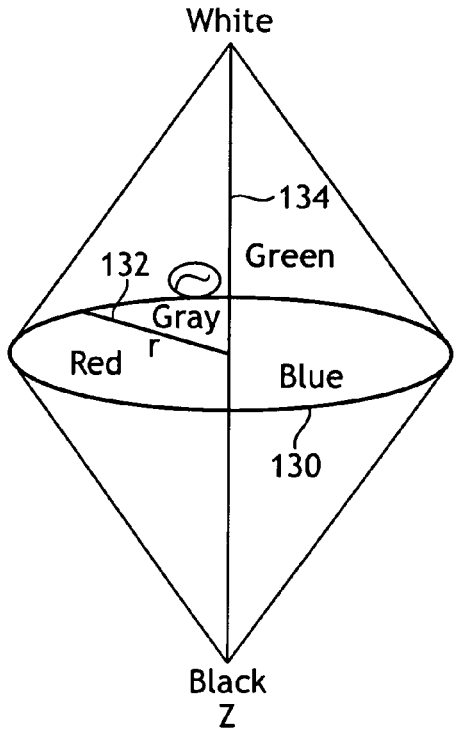
FIG. 11 shows a schematic graphical illustration of hue, luminosity and saturation/vividness.

Generally, two colors are considered different if they have first and second hues that are more than ±0.50 degrees from each other on the circle 130 of FIG. 11, alternatively ±5 degrees, alternatively ±30 degrees, alternatively ±90 degrees, alternatively ±150 degrees and alternatively ±175 degrees. Value (luminosity) is measured along the Z-axis 134 between white and black. Colors are considered different if they have a value difference of at least 1% of maximum (Polaroid white reference standard). A value of 1 equates to white, while a value of 0 equates to black. Saturation/vividness is measured along the length of the radius (r) 132. Colors are considered different if they have a saturation difference of at least 2.5% of maximum.

At the same time, the first color of the personal care product component, such as the absorbent product, can be coordinated with the first color of one or both of the packaging components. In one embodiment, the second color of the personal care product component, such as the absorbent product, is also coordinated with the second color of one or both of the packaging components. The coordination of the colors is most desirable at distances of less than two feet, such that it is visible to the user of the product. At the same time, the coordination can provide a disguising aspect that is effective for an observer who is greater than 2 to 3 feet away from the product.

Two colors are considered coordinated if they have first and second hues that are within about ±120 degrees of each other on the circle 130, alternatively within ±30 degrees, alternatively within ±15 degrees, alternatively within ±10 degrees, alternatively within ±5 degrees of each other, or alternatively within ±0.50 degrees of each other. Colors are also considered coordinated if they have a value (luminosity) difference of less than about 5% of maximum, alternatively less than about 30% of maximum or alternatively less than about 1% of maximum. Colors are also considered coordinated if they have a saturation difference of less than about 5% of maximum, alternatively less than about 30% of maximum or alternatively less than about 2.5% of maximum.

The hue, luminosity and saturation/vividness are measured as follows using the following equipment calibrated in the following way.

Equipment

Quantitative calorimetric measurements are typically made using a calorimeter or spectrophotometer. However, these instruments typically have large apertures (~1 cm) requiring a large color block for meaningful determination, making them unsuitable for color determination of graphics that may be composed of narrow lines or points whose width is much less than the instrument aperture. Therefore, a Zeiss KS400 Image Analysis system was used for feature identification and calorimetric measurement.

The Zeiss KS400 used a Zeiss AxioCam color CCD camera (1300×1030 pixels, 3 channel color, 8 bit per channel) equipped with a 20 mm AF-Nikkor lens (f/2.8). The camera was mounted vertically facing down onto a sample stage and had an effective field of view was 97×80 mm. Incident sample stage illumination was by four incandescent floodlamps (Sylvania) on a double Variac (70%; 90%), resulting in an illuminance of approximately 11,000 lux. The lamps were above the left and right edges of the sample stage directed towards the field of view at approximately 45 degrees.

Calibration

The camera black reference was with the lens cap on. The camera white reference was a Polaroid 803 positive with 15 ms exposure. To account for the warm color illumination bias of the floodlamps, the red, green, and blue (RGB) values were offset using the white selection tool in the KS400 software, resulting in corrected RGB values that yielded a white image.

Sample Setup and Image Acquisition

Samples are placed on the stage (normal viewing angle) and under ¼" plate glass to minimize topographical effects. Images of the color-bearing graphical portion are acquired at 15 ms exposure.

Image Analysis

Image analysis is performed in Matlab (v.6.5.1, release 13; Mathworks, Inc) with the Image Processing Toolbox (v4.0). RGB images were converted to hue, saturation, and value (HSV) space using Matlab's hsv2rgb.m command. Choosing a saturation lower limit of 0.05 (0-1 scale) resulted in practical detection of all the colored/inked portions of the graphic. The hue, saturation, and value (i.e. luminosity) densiometric distributions were calculated for the detected regions in each image.

The container component of the present invention has a chamber which is designed to hold at least two absorbent personal care articles. Typically, the absorbent personal care articles positioned within the chamber are of the same type; however, it is not outside the present invention for absorbent personal care articles stored within the chamber to be of different types. For example, the chamber may contain pantiliners and tampons, pantiliners and incontinent products, incontinent products and menstrual pads, and so forth. Likewise, the absorbent article within the container component could be of the same type but have different absorbencies, for example an overnight sanitary napkin and a regular or daytime sanitary napkin. Generally, the personal care product of the present invention contains between 2 and 200 individual absorbent personal care articles, preferably between about 5 and 50 individual personal care products.

EXAMPLE

A packaging component having a generally purple color was prepared from a paperboard unitary blank shown in FIG. 6. The container has a height of about 75 mm, a width of approximately 140 mm and a depth of about 80 mm. Inside the container all of the interior walls, interior panels, and the interior surface of the top and bottom are also a purple color, similar to a color of the exterior surface of the container. An opening device is present, which divides the container into an upper portion and a lower portion. The opening device is a perforation which extends in a straight line across the front side wall at a height of about 42 mm from the bottom surface. On each side panel, a perforation line extending from the intersection of each side wall and the back side panel at a height of about 60 mm to intersection of each side wall with the front side wall at a height of about 42 mm. The perforations on each side wall are a series of lands about 1 mm each spaced apart by slits of about 10 mm in length. The perforations on the front side wall are 1 mm lands separated by slits of about 5 mm in length. Along the back side wall, about 60 mm from the bottom surface, a series of lands and slits, each about 20 mm in length form a hinge and the top portion of the container is allowed to pivot in relation to the bottom portion of the container, thereby forming an attached lid, similar to that shown in the figures.

Placed within the container are 46 tri-folded lavender scented pantiliners, each individually wrapped in a wrapper having a color similar to the purple color on the interior surface of the container. Each wrapper having a dimensions of about 75 mm by 65 mm and a thickness, including, the pantiliner, of about 2.5 mm each. The 46 wrapped pantiliners are further wrapped with a tissue paper having a purple color hue. The tissue paper is about 32.5 cm in length and about 13 cm wide and encircles the pantiliners as shown in FIG. 7, with circular tape having a gold color holding the ends of the tissue paper in place.

Each side wall and the top of the container does not contain any indicia as to the contents of the container. The bottom has indicia conveying the manufacture and contact information for the manufacture of the absorbent articles. An overwrap material is wrapped around the side walls of the container, as shown in FIG. 9. The overwrap has a length of about 44 cm and a width of about 7 cm. The overwrap material is prepared from a clear polyethylene film and has indicia located on the film including branding, product information, instructions of how to open the container, instructions how to use the product and a barcode.

Those skilled in the art will recognize that the present invention is capable of many modifications and variations without departing from the scope thereof. Accordingly, the detailed description and examples set forth above are meant to be illustrative only and are not intended to limit, in any manner, the scope of the invention as set forth in the appended claims.

The invention claimed is:

1. A package for personal care products comprising:

a container component comprising a top panel, a bottom panel and at least one side wall, top panel is connected to the bottom panel by at least one side wall each wall and panel having an interior surface and an exterior surface, wherein the interior surface of each of the bottom panel and the at least one side wall define a chamber for holding at least two absorbent personal care articles; and a plurality of absorbent personal care articles placed within said chamber of the container component;

wherein the exterior surface of each of the top panel, and the at least one side wall, is devoid of any indicia which tends to indicate that the container has at least one personal care product placed within said chamber, wherein the at least one side wall comprises a front side wall, a back side wall, a first side wall and a second side wall, wherein the top panel is connected to the bottom panel by the front side wall, the back side wall, the first side wall and the second side wall; and the front side wall is connected to the back side wall by the first side wall and the second side wall, each wall having an interior surface and an exterior surface, wherein the interior surface of each of the bottom panel, the front side wall, the back side wall, the first side wall and the second side wall define a chamber for holding at least two absorbent personal care articles; and wherein the exterior surface of each of the top panel, the front side wall, the first side wall and the second side wall is devoid of any indicia which tends to indicate that the container has at least one personal care product placed within said chamber; and further comprising an interior panel, an opening device, an inner material component and an exterior material component, wherein the interior panel comprises a first section, a second section and a third section, wherein the first section is joined to the third section by the second section, and the first section is in contact with a portion of the interior surface of the first side wall, the second section is in contact with a portion of the interior surface of the front side wall and the third section is in contact with a portion of the interior surface of the second side wall, the opening device divides the container component into a top section and a bottom section, said top section comprises the top panel, at least a portion of the front side wall, an upper portion of the first side wall and an upper portion of the second side wall and said bottom section comprises the bottom panel, at least a portion of the back side wall, a lower portion of the first side wall and a lower portion of the second side wall; the opening device comprises a line of weakness starting at a location on the first side wall at a first point where the first side wall intersects the back side wall, said line of weakness extends to the front side wall and the second side wall, ending at a location on the second side wall at a second point where the second side wall intersects the back side wall, a second line of weakness on the back side wall, which connects the first point to the second point, the first line of weakness allows the upper portion of the first side wall, the upper portion of the second side wall and the portion of the front side wall, to be separated from the lower portion of the first side wall, the lower portion of the second side wall and any lower portion of the front side wall present, respectively, and the second line of weakness provides a pivoting axis which allows the top portion to pivot relative to the bottom portion along the second line of weakness and a portion of the interior surface of the upper portion of the first side wall and a portion of the interior surface of the upper portion of the second side wall contact first section and the third section of the interior panel, when the package is in a closed position; the inner material encircles at least a portion of the absorbent personal care articles placed within the chamber and the inner material has a first end and a second end, the inner material encircles the absorbent personal care articles such that the first and second end overlap each other towards the front side wall of the container, and the first end is removably attached to the second end; the exterior material component contacts at least a portion of the outer surfaces of at least four walls of the container component and exterior material component comprises indicia which indicates that the container comprises at least one personal care product placed within said chamber.

2. The package of claim 1 further comprising a plurality of wrapper components, wherein each of the absorbent personal care articles is placed within a wrapper component, and the wrapper component and absorbent articles are placed with the chamber of the container component.

3. The package of claim 2 wherein the wrapper comprises a color hue and at least a portion of the exterior surface of the container comprises the same color hue.

* * * * *